US005322439A

United States Patent [19]

Young

[11] Patent Number: 5,322,439

[45] Date of Patent: Jun. 21, 1994

[54] DENTAL CONTROL UNIT WITH REMOVABLE HANDLE

[75] Inventor: Barry S. Young, Tualatin, Oreg.

[73] Assignee: MDT Corporation, Torrance, Calif.

[21] Appl. No.: 976,494

[22] Filed: Nov. 13, 1992

[51] Int. Cl.[5] ..... A61G 15/00

[52] U.S. Cl. ..... 433/77; 433/79

[58] Field of Search ..... 433/33, 49, 77, 78, 433/79; 294/165, 167, 145, 158

[56] References Cited

U.S. PATENT DOCUMENTS

| | | | |
|---|---|---|---|
| 3,923,191 | 12/1975 | Johnson | 294/158 X |
| 4,142,660 | 3/1979 | Culbertson | 294/158 |
| 4,176,423 | 12/1979 | Wigemark | 294/158 X |
| 4,359,316 | 11/1982 | Kümmel et al. | 433/79 |
| 4,571,182 | 2/1986 | Beier et al. | 433/79 |
| 4,976,616 | 12/1990 | Eisner et al. | 433/77 |
| 5,161,970 | 11/1992 | Baskas | 433/77 |

FOREIGN PATENT DOCUMENTS

| | | | |
|---|---|---|---|
| 2554936 | 6/1977 | Fed. Rep. of Germany | 294/145 |

*Primary Examiner*—Gene Mancene
*Assistant Examiner*—Cindy A. Cherichetti
*Attorney, Agent, or Firm*—Trask, Britt & Rossa

[57] ABSTRACT

A dental control unit of the kind pivotally mounted on a swinging arm and having a support base for operatory equipment and a housing covering said equipment and base includes a pair of fully interchangeable handles, releasable mounted to the bottom of the base and means on the top of the base to lock the handles to the bottom of the base with the handles being selectively locked in place and released by movement of finger tabs projecting through the base by an operator grasping the handles beneath the base.

9 Claims, 4 Drawing Sheets

DENTAL CONTROL UNIT WITH REMOVABLE HANDLE

BACKGROUND OF THE INVENTION

1. Field of the Invention

This invention relates to dental control units. It is particularly directed to such units which are adapted for holding dental hand pieces chair-side for easy retrieval, use and return to storage by dentists during a patient procedure.

2. State of the Art

In recent years, the use of dental control units of the commonly known as "Continental" control units, (because of their initial development and popularity in Europe), has become more and more widespread. These units are characterized by being mounted closely adjacent a dental patient's chair. They are thus readily accessible to a dentist conducting a procedure involving a patient in the chair.

Dental control units in general include a base mounted to swing with and to pivot on a support arm. A housing fits over the base to provide a cover for control mechanisms carried by the base and serving as flow control means for utility supply conduits extending from the base. Typical such dental control units support a plurality of dental hand pieces, the associated utility supply conduits and structure for controlling flow through the conduits. In Continental-style dental control units, the supply conduits extend through pivoted "whip" arms which rest on the housing for easy access by a dentist or technician. The conduits terminate in quick release ends to which dental hand pieces are attached, and provide means for supplying vacuum, water, air and various solutions to the hand pieces.

The desired positioning of the control unit relative to the dentist and patient is usually accomplished by grasping a handle or a pair of handles affixed to the base. Preferably, the handle or handles are easily removed to facilitate cleaning.

SUMMARY OF THE INVENTION

The present invention provides a dental control unit having handles that are releasably attached to and removed from its base.

The handles are located for convenient grasping by a dentist or technician in the desired positioning of the control unit. The handles are also located to be relatively isolated from the splash and spray which inevitably occurs during dental procedures.

The handles are mounted to extend from opposite sides of the bottom of the base. They are structured and arranged so that they can be attached and removed with one hand. The structure of the preferred embodiments permits a single elongate handle to be used as either a right or left hand handle of the control unit. Ideally, the handles are symmetrical so that either end can be secured either at the front or at the rear of the base. The locking structure may be mounted to the base within the housing, hidden from view and isolated from contamination.

Each handle may carry structurally similar locking projections at opposite ends (arbitrarily considered to constitute a front end and a rear end, depending upon the orientation of the handle). These projections are insertable into corresponding receptacles carried by the base at its front and rear, respectively. The projections are urged into firm locking engagement with structure associated with the receptacles by a finger actuated mechanism. In a typical arrangement of the invention, a finger tab is manipulated at either the front or the rear of the base to swing a lever arm within the housing. Structure (typically an adjustable cam) carried by the arm engages a first (typically the front) locking projection on the handle, and forces both front and rear locking projections on the handle into locking engagement with structure (typically ramps) on the base.

Removal of a handle is simply a matter of releasing the cam operated by the lever arm from engagement with the locking projection, sliding the handle out of engagement with the ramps and allowing the handle to fall free of the base.

BRIEF DESCRIPTION OF THE DRAWINGS

In the drawings, which illustrate what is presently regarded as the best mode for carrying out the invention.

DETAILED DESCRIPTION OF THE INVENTION

Figure 1:
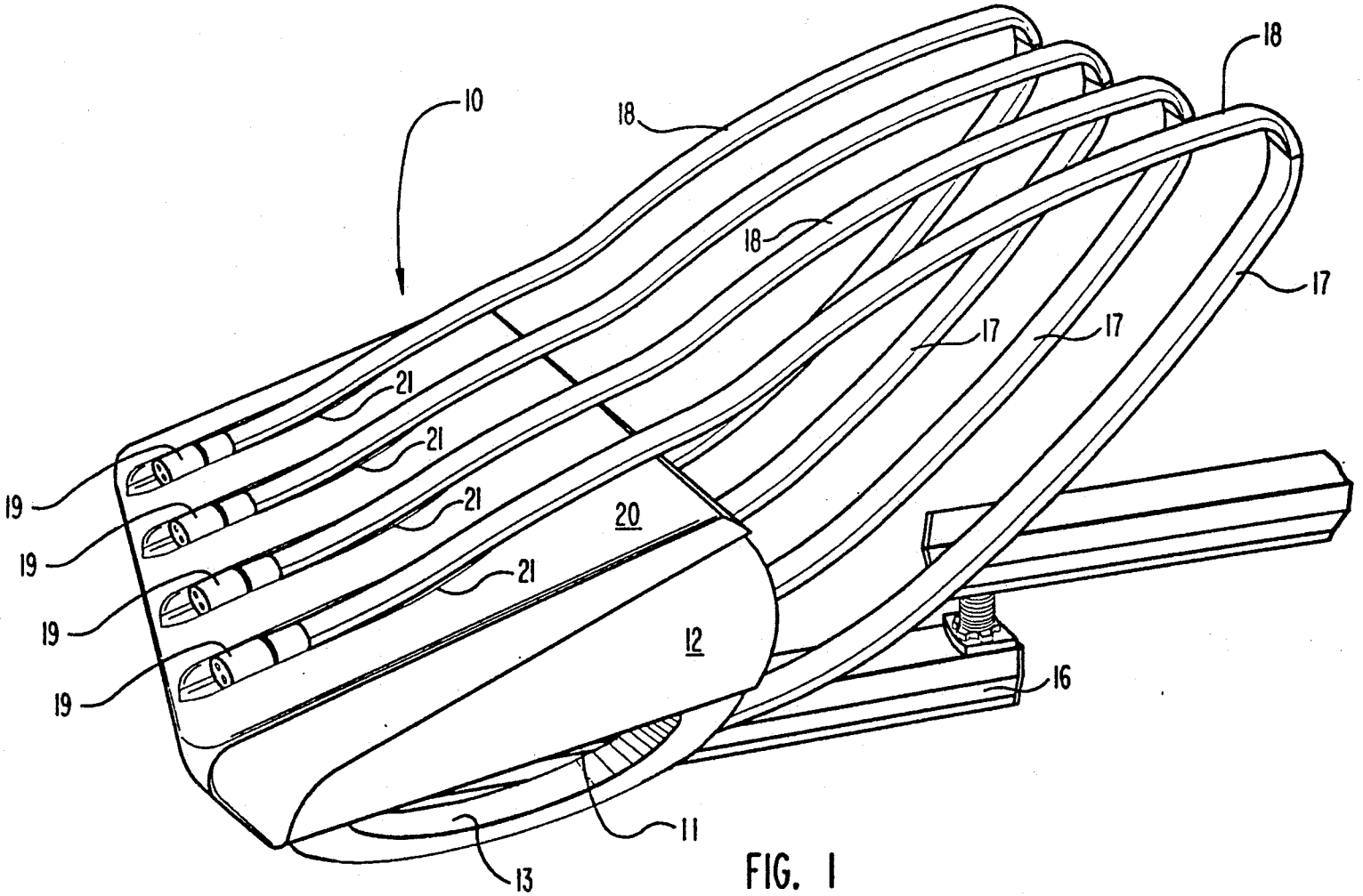
FIG. 1 is a perspective view of a Continental dental control unit according to the present invention.

In the illustrated preferred embodiment of FIGS. 1-5, the dental control unit of the invention, shown generally at 10, includes a flat support base 11, a housing 12, and a pair of handles 13. A locking mechanism, shown generally at 15 (FIG. 3) at opposite sides of base 11, removably attaches each of the handles 13 to the base 11. The base is pivotally mounted on a swing arm 16, in conventional fashion.

At least one whip arm 17, pivotally connected to the base 11, supports a conduit 18 that has a coupling 19 on the free end thereof for attachment to a dental hand piece. Conventional mechanism mounting the whip arm and conventional control mechanism for controlling flow through the conduit 18 are normally provided within the housing 12 and on the base 11. For purposes of clarity, the mounting and control mechanisms are not shown in the drawings. The whip arm 17 carries the conduit 18 and keeps the conduit from being tangled with other conduits or other structures and out of the way when not in use.

A top cover 20 of the housing 12 is formed with positioning grooves 21 which function to hold the ends of each conduit 18, when that respective conduit is not in use.

Figure 2:
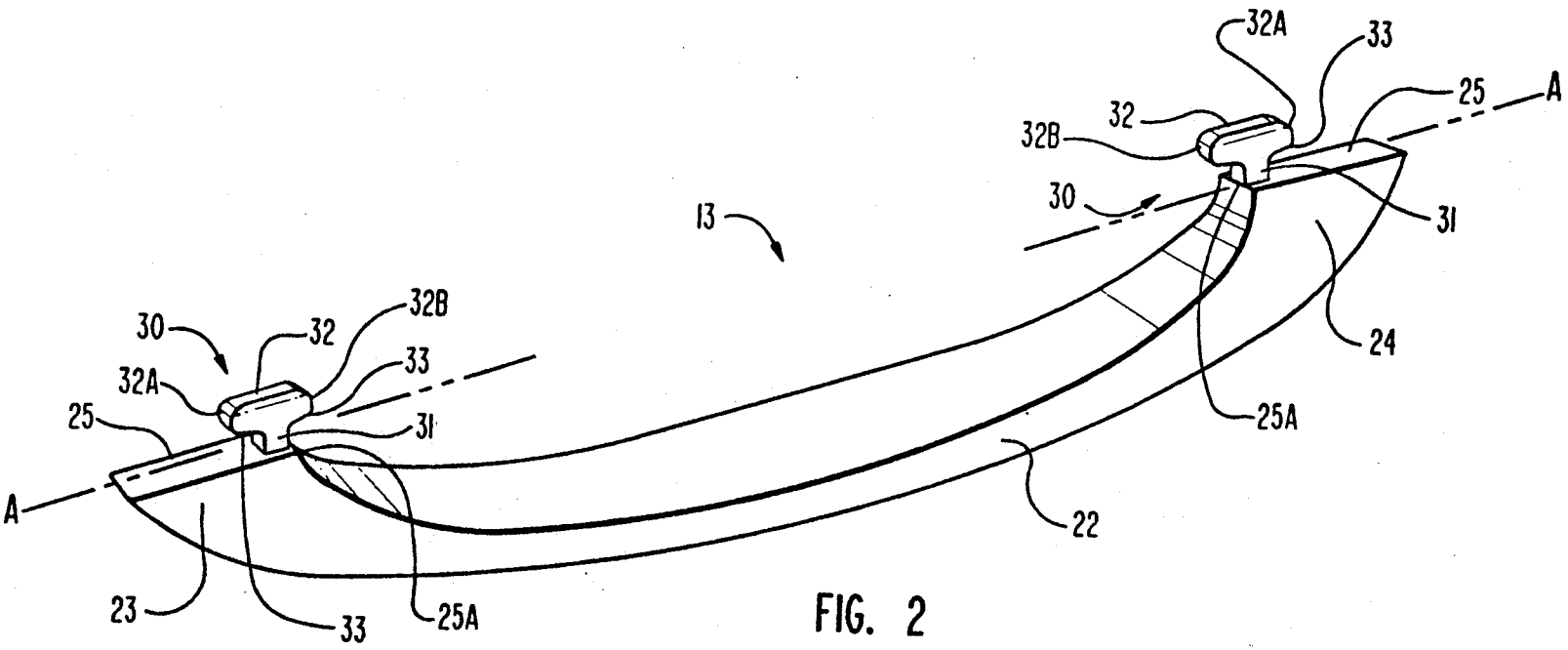
FIG. 2 is a perspective view of a handle of the invention.
Figures 3, 3A:
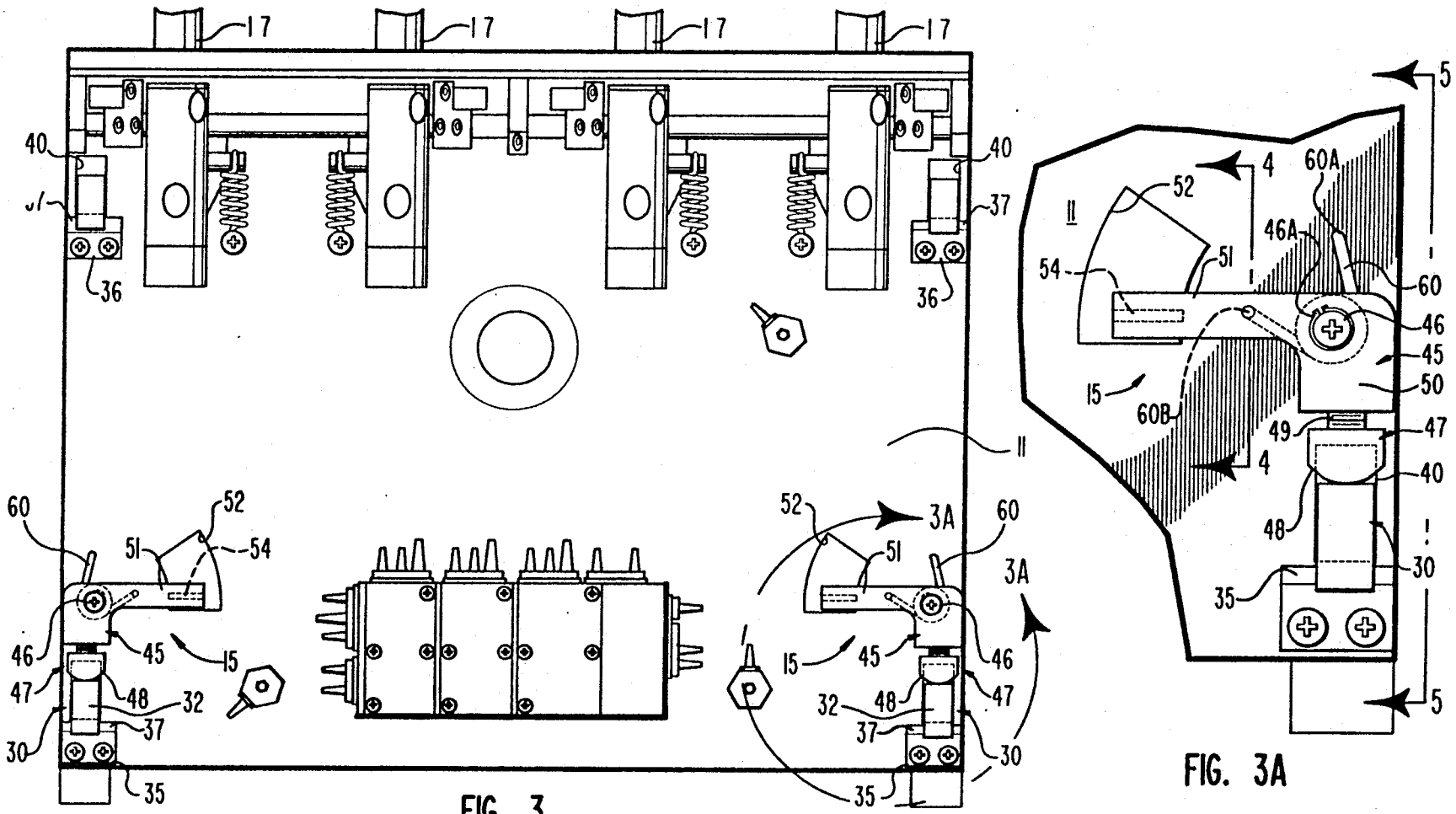
FIG. 3 is a top plan view of a base of the control unit of FIG. 1 showing a typical locking mechanism for the handles.
FIG. 3A is an enlarged view of a locking mechanism for a handle, taken within the line 3A—3A of FIG. 3.

The handles 13 are identically constructed, as shown by FIG. 2. Each handle 13 is configured to be fully interchangeable, i.e., from side to side with respect to base 11 and reversible, i.e., turned end to end. Each handle 13 is formed with a curved central section 22 terminating in identically formed ends 23 and 24. Each end 23 and 24 has a flat surface 25 adapted to rest tightly against the flat bottom of base 11.

A locking projection 30 extends from each flat surface 25 and includes a neck 31 and an elongate head 32 interconnected by shoulders 33. As illustrated, the shoulders 33 curve angularly outwardly from the neck 31 to the edges 32A, 32B of the elongate head 32. Each neck 31 connects to the flat surface 25 adjacent its junction 25A with the curved central section 22 and centered on a central elongate axis A through the handle 13.

A pair of spaced apart ramps 35 and 36 are provided at each of the left and right sides (as viewed in FIG. 3) of the top surface of base 11. Ramps 35 are adjacent the front edge of base 11 and ramps 36 are spaced inwardly of a rear edge of the base 11.

Figure 4:
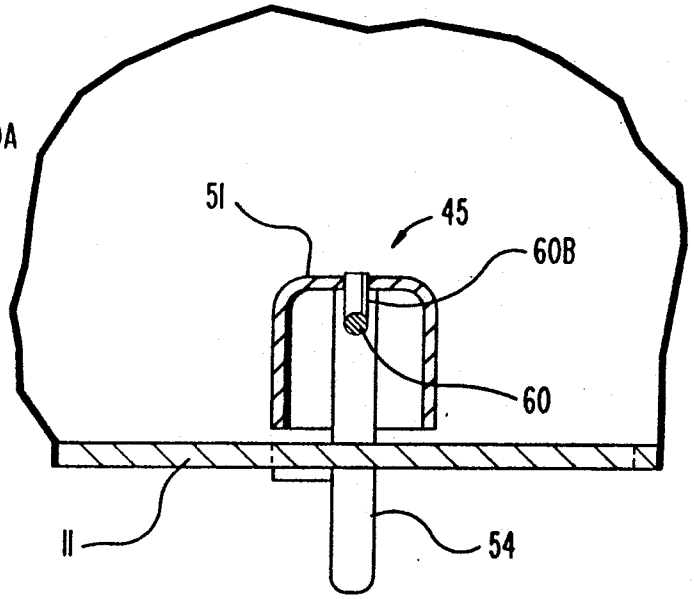
FIG. 4 is a fragmentary vertical section view, taken on the line 4—4 of FIG. 3.
Figure 5:
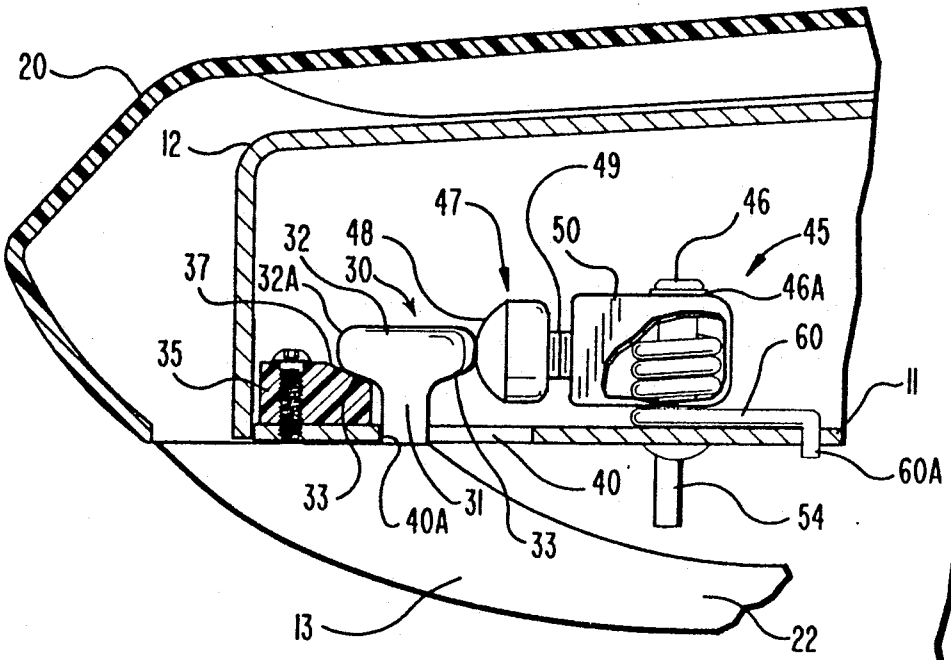
FIG. 5 is an enlarged fragmentary vertical section view, taken on the line 5—5 of FIG. 3.

Each ramp 35 and 36 includes an angled top surface 37 positioned adjacent a forward end 40A of an elongate hole 40 formed through the base 11 (FIG. 5). Thus, when the locking projections 30 of the handles 13 are inserted upwardly from beneath the base 11, through the holes 40, and the handle is moved toward the front of the base 11, as viewed in FIGS. 3–5, and toward the ends 40A of the holes 40, the shoulders 33 of the locking projections 30 wedge against the ramp surfaces 37.

An L-shaped lever 45 is journaled on a pivot pin 46 that is fixed to and extends upwardly from the top surface of base 11. A horseshoe clip 46A fits in a groove of the pin 46 to hold the lever 45 in place on the pin. A cam member 47 has a rounded end surface 48 and a threaded stem 49 that is threaded into one end of a first leg 50 of the L-shaped lever 45.

A second leg 51 of the L-shaped lever 45 reaches over the top surface of base 11 to an arcuate slot 52. A tab 54 (FIGS. 4 and 5) depends from the leg 51 through the slot 52 to provide an actuator for pivoting of the arm 45. A spring 60 is mounted with a first bent end 60A inserted into a hole in the base 11 as shown by FIG. 5, and a second bent end 60B inserted into a hole in the leg 51 of the L-shaped lever 45 as shown by FIG. 4. The central portion of the spring 60 is coiled around pivot pin 46, and the spring 60 thus biases the lever arm 45 and the cam member 47 out of engagement with a locking projection 30.

In securing a handle 13 to the base 11, a user grasps the handle and inserts the locking projections 30 of the handle through the elongate holes 40 at one side of base 11 from beneath the base. The tab 54 is then moved towards the front edge of the base and the rounded end surface 48 engages the elongate head surface 32B of locking projection 30 that is nearest the forward edge of the base 11 to force the surfaces 33 of both locking projections 30 of the handle onto the ramps 35 and 36. One locking projection 30 is then wedged between the edge 40A of the slot 40 and the cam member 47. As a consequence, the shoulders 33 of both locking projections 30 are wedged against the inclined surfaces 37 of both of the ramps 35 and 36.

The lever 45 is held in this "locked" position, and against return movement, under the influence of spring 60, by friction between the surface 32B and the rounded cam head 47. It is within contemplation to configure the surface 32B to receive the cam 47. In any event, the frictional force at the interface between the surfaces 32B and 47 may be adjusted by turning the threaded shaft 49 appropriately.

An attached handle 13 is removed by the user grasping the central section 22 and, with one finger, pushing on the tab 54 to pivot the cam member 47 out of wedging engagement with the structure 30. The handle 13 is then moved away from the ends 40A of the elongate holes 40 to disengage the locking projections 30 from the ramps 35 and 36 and is lowered away from the base 11 through holes 40.

The positioning of the handles 13 beneath the base 11, housing 12 and top cover 20 protects them from splash and spray from above and helps to maintain them clean. At the same time, one or both of the handles is readily grasped by a dentist, or dental assistant, to position the control unit where desired.

While a preferred embodiment of the invention has been illustrated and described, it is intended that the invention be limited only by the appended claims, including reasonable equivalents.

What is claimed is:

1. A dental control unit comprising:

a support base having a top surface and a bottom surface;

at least one rigid handle removably secured to said bottom surface of said base, said handle including: a central section, terminating in ends with base engaging surfaces, and a locking projection extending from each base engaging surface;

a pair of spaced apart receptacles in said base, constructed and arranged to receive said locking projections; and locking means mounted on the top of said base constructed and arranged releasably to engage said locking projections within said receptacles;

said base engaging surfaces being positioned tightly against said bottom surface of said base when secured to said bottom surface, thereby isolating said locking projections and said locking means from the environment surrounding said dental control unit.

2. A dental control unit according to claim 1, wherein:

said receptacles comprise a pair of spaced apart slots through the base, arranged so that said locking projections register with and may be inserted through said slots; and said locking means operates releasably to hold said base engaging surfaces against the bottom of said base.

3. A dental control unit comprising:

a support base having a top surface and a bottom surface;

at least one handle means removably secured to said bottom surface of said base, said handle means including a central section, terminating in ends with base engaging surfaces, and a locking projection extending from each base engaging surface;

a pair of spaced apart receptacles in said base, constructed and arranged to receive said locking projections; and locking means mounted on the top of said base constructed and arranged releasably to engage said locking projections within said receptacles, said receptacles comprising a pair of spaced apart slots through the base, arranged so that said locking projections register with and may be inserted through said slots; and said locking means being releasably operable to hold said base engaging surfaces against the bottom of said base;

each said locking projection including a neck to extend through one of said slots, a head on the end of said neck remote from said base engaging surface and a shoulder interconnecting said neck and said head; and each said locking means including a ramp adjacent a respective said slot to engage said shoulders of said locking projections, and means to cam said locking projections into wedging engagement with said ramps.

4. A dental control unit as in claim 3, wherein:

the said means to cam said locking projections into wedging engagement with said ramps includes an approximately L-shaped arm pivotally journaled about a pivot pin fixed to and projecting from said top surface of said base and having a first leg with a finger tab on its end and a second leg carrying a cam member in position to be pivoted into engagement with a head structure of one of said locking projections.

5. A dental control unit as in claim 4 further including:

means biasing said L-shaped arm to move said cam member out of engagement with said head.

6. A dental control unit as in claim 5, wherein:

said biasing means comprises a spring coiled around said pivot pin and having a first end anchored to said base and a second end anchored to said L-shaped arm.

7. A dental control unit as in claim 6, wherein:

said cam member includes a curved surface to engage said head of said locking projection and an adjustment stem threaded into the end of said second leg of said L-shaped arm.

8. A dental control unit as in claim 7, further including:

a curved slot through said base; and wherein said tab extends through said slot to be manipulated beneath said base.

9. A dental control unit as in claim 6, further including:

a curved slot through said base; and wherein said tab extends through said slot to be manipulated beneath said base.

* * * * *